US006031301A

United States Patent [19]

Callahan et al.

[11] Patent Number: 6,031,301

[45] Date of Patent: Feb. 29, 2000

[54] REMOTELY CONTROLLED TOGGLE SWITCH

[75] Inventors: Mark Arthur Callahan, Stewartstown, Pa.; Jeffrey Joseph Perloski, Freeland, Md.; Christopher Joseph Murk, Monkton, Md.; John Nicholas Merkle, Reisterstown, Md.; David Anthony Franckowiak, Bel Air, Md.

[73] Assignee: AAI Corporation, Cockeysville, Md.

[21] Appl. No.: 09/001,689

[22] Filed: Dec. 31, 1997

[51] Int. Cl.[7] ..... H01H 21/18

[52] U.S. Cl. ..... 307/119; 307/139; 307/140; 200/17 R; 200/31

[58] Field of Search ..... 307/119, 139, 307/140; 200/17 R, 329, 331, 336, 337, 61.58 R, 39 R, 401; 335/192

[56] References Cited

U.S. PATENT DOCUMENTS

| | | | |
|---|---|---|---|
| 3,734,869 | 5/1973 | Menard et al. | 200/17 R |
| 4,151,385 | 4/1979 | Neuser et al. | 200/337 |
| 4,389,550 | 6/1983 | Reiter | 200/61.58 R |
| 5,464,953 | 11/1995 | Kim | 200/39 R |

*Primary Examiner*—Albert W. Paladini
*Attorney, Agent, or Firm*—Venable; James R. Burdett; Catherine A. Ferguson

[57] ABSTRACT

A simulated toggle switch capable of being set and reset by remote means and being manually operated. Control signals are received by two on-board electronic drive circuit assemblies which cause two corresponding magnetic solenoids to drive two cams clockwise or counterclockwise, independently of each other. This, in turn, causes a bat handle to move to an uppermost position, a lowermost position, or to be centered. In addition, the position of the switch is remotely sensed.

34 Claims, 5 Drawing Sheets

REMOTELY CONTROLLED TOGGLE SWITCH

CROSS REFERENCE TO RELATED APPLICATIONS

This application is related to the following applications: "Remotely Controlled Simulated Linear Circuit Breaker Assembly" (Ser. No. 09/002,082) by Mark Arthur Callahan, Jeffrey Joseph Perloski, Christopher Joseph Murk and John Nicholas Merkle; "Smart Test Equipment/ID Tagged Test Points" (Ser. No. 09/002,084) by Jeffrey Joseph Perloski, Paul Joseph Hoshall and Lester Louis Smith; and "Simulated Rotary Switch" (Ser. No. 09/002,083) by Mark Arthur Callahan, Jeffrey Joseph Perloski and Richard Michael Quintavalle, each of which is filed concurrently herewith, commonly owned, and incorporated herein by reference.

BACKGROUND OF THE INVENTION

When a student uses System Test Equipment (STE), the trainer must typically reset all toggle switches to a normal initial operating position on the remotely controlled equipment prior to allowing the trainee to begin his testing. Existing equipment allows detection of the positions of the toggle switches. However, they cannot automatically be set to the desired initial positions. The prior art does not contain an apparatus for automatically presetting the positions of the switches.

SUMMARY OF THE INVENTION

One object of the invention is to provide a toggle type switch that can be remotely set and reset in lieu of manual set and reset.

In addition, a second object of the invention is to provide a toggle type switch whose position can be remotely sensed.

Still a third object of the invention is to provide a toggle type switch which provides the same feel and appearance as an ordinary toggle type switch and can be manually operated.

DETAILED DESCRIPTION OF THE INVENTION

Figure 1:
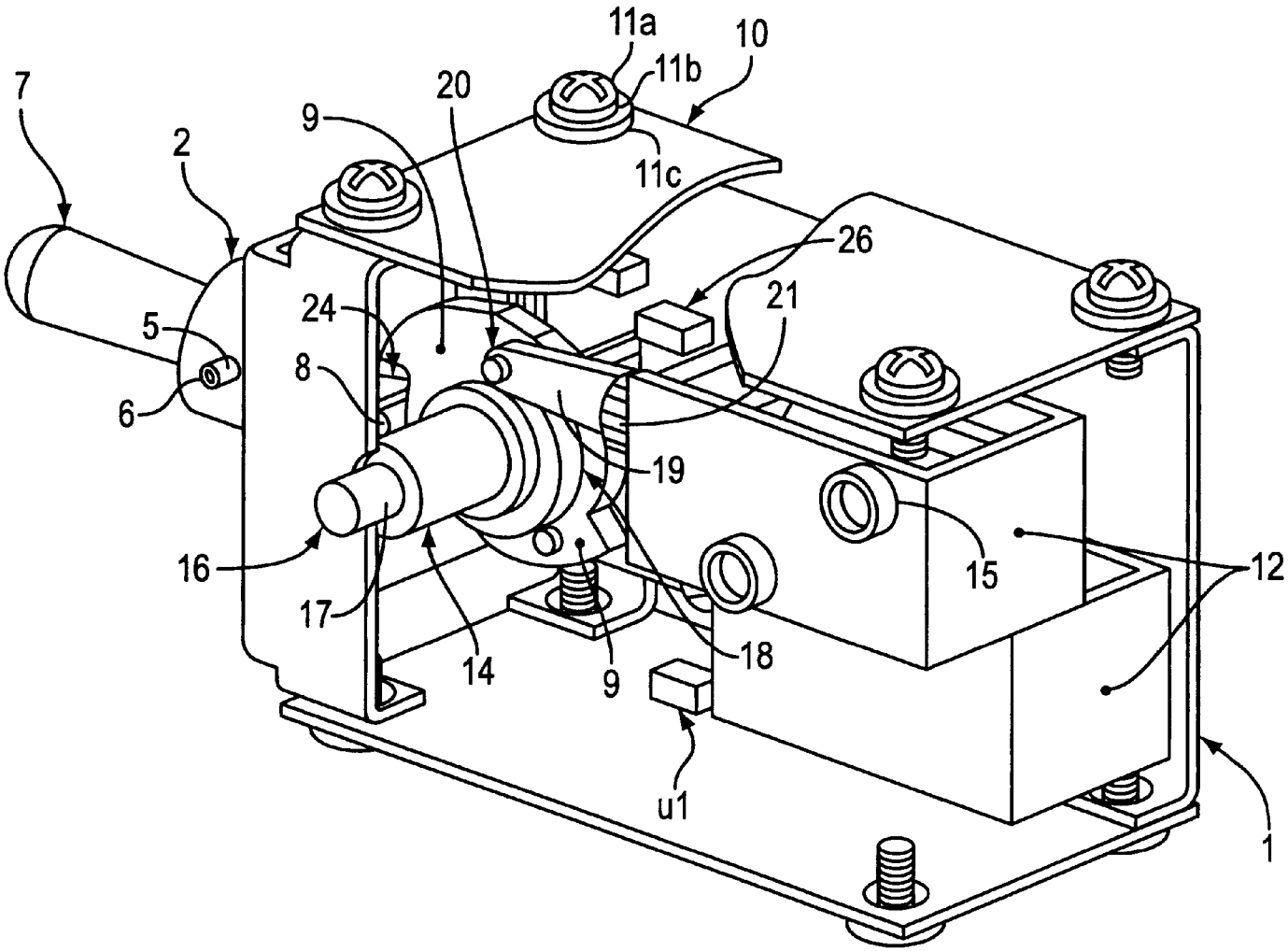
FIG. 1 is an assembly drawing of the remotely controlled toggle switch assembly.
Figure 3:
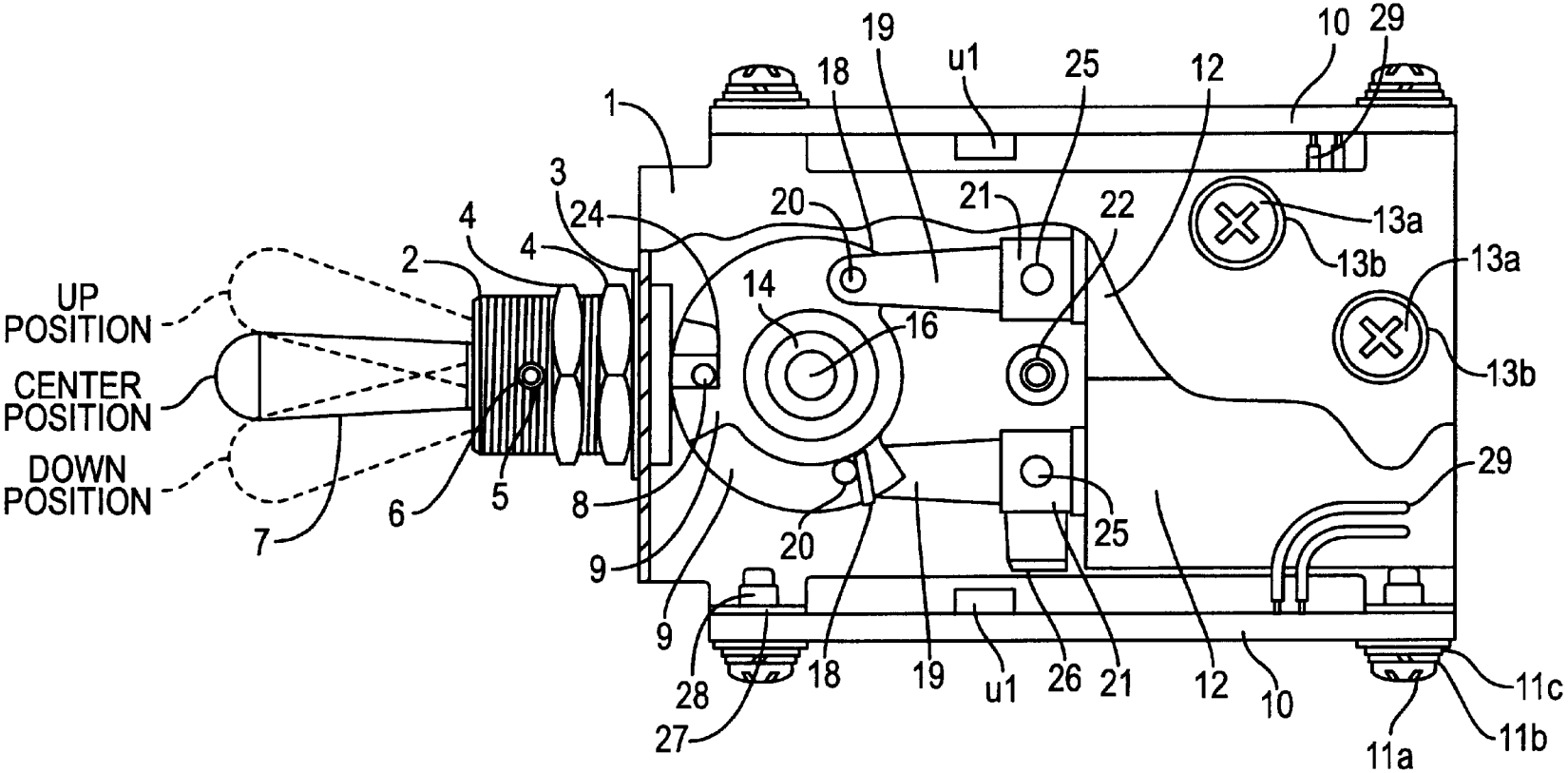
FIG. 3 is a detailed side view of the remotely controlled toggle switch assembly with part of the mounting bracket removed for clarity.
Figure 4:
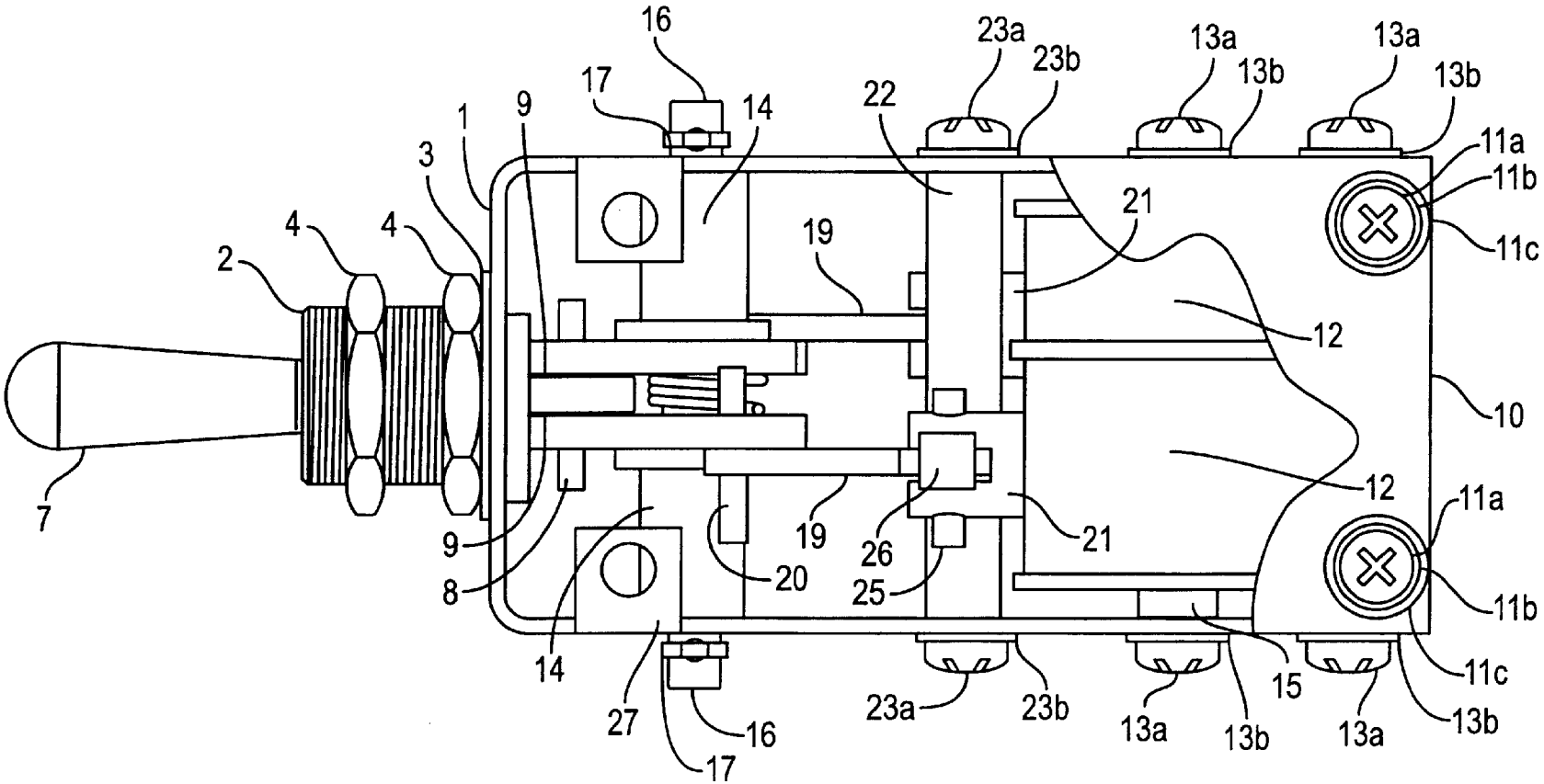
FIG. 4 is a detailed top view of the remotely controlled toggle switch assembly with part of the electronic drive circuit card assembly removed for clarity.

The components of the remotely controlled toggle switch are described with reference to FIGS. 1, 3 and 4. The remotely controlled toggle switch's mounting bracket 1 provides the mounting frame for the assembly's components and also provides the mounting interface for the assembly via a threaded bushing 2, a lockwasher 3, and two nuts 4. The threaded bushing 2 also provides a pivot point 5 for the bat handle 7 via a first spring roll pin 6 which is pressed through the bushing 2 and handle pieces 7. At the end of the bat handle 7 is a second spring roll pin 8, which is used by two cams 9 to actuate the bat handle 7 to its up, center, and down positions. Two electronic drive circuit cards 10 are fastened with four screws 11*a*, lockwashers 11*b*, and flat washers 11*c* to ears 27 located on the top and bottom of the mounting bracket 1, which have four threaded inserts 28 pressed in. Two magnetic latching solenoids 12 are similarly fastened to the sidewalls of the mounting bracket 1 with two screws 13*a* and lockwashers 13*b*. Two spacers 15 between each solenoid 12 and the mounting bracket 1 provide for alignment of the solenoids 12 within the assembly. Two solenoid coil winding leads 29 from each solenoid 12 are soldered to plated through holes on their respective electronic drive circuit card assembly 10. A round shaft 16, which is held with cotter pins 17 on either side of the mounting bracket 1 is used to support and allow for the rotation of two spacer bushings 14, two cam assemblies 9, and a torsion spring 18. Two push rods 19, two front spring roll pins 20 and a rear spring roll pin 25 connect the solenoid plungers 21 to the cam assemblies 9. A threaded shaft 22 mounted with two screws 23*a* and lockwashers 23*b* provides structural support to the center of the mounting bracket 1.

The toggle switch operates as follows. With both latching solenoid plungers 21 retracted into their housings 12 as shown in FIGS. 3 and 4, their respective push rods 19 rotate each of the cam assemblies 9 on the shaft 16 to their rearmost positions (clockwise for the top push rod 19 and cam 9 and counterclockwise for the bottom push rod 19 and cam 9 as viewed with the bat handle 7 facing left). Rotation of the cams 9 to this position allows the actuating notches 24 in the cams 9 to engage the bat handle's 7 second spring roll pin 8 in a perpendicular orientation, resulting in the bat handle 7 being centered in its bushing 2.

With the bottom solenoid's plunger 21 retracted in its housing, when the top solenoid's plunger 21 is ejected from its housing, its associated cam 9 rotates counterclockwise on the shaft 16 (to the left as viewed with the bat handle 7 facing left). This enables the notch 24 in the top solenoid's 12 cam to press down on the bat handle's 7 spring roll pin 8, pushing the bat handle 7 to its uppermost position.

Conversely, with the top solenoid's plunger 21 retracted in its housing, when the bottom solenoid's plunger 21 is ejected from its housing, its associated cam 9 rotates clockwise on the shaft 16 (to the right as viewed with the bat handle 7 facing left). This enables the notch 24 in the bottom solenoid's 12 cam to press up on the bat handle's 7 spring roll pin 8, pushing the bat handle 7 to its lowermost position. The torsion spring 18 is used to preload both cams 9 by engaging the spring roll pin 20 that attaches each push rod 19 to each cam 9.

The two magnetic latching solenoids 12 operate the toggle switch in the following manner. When an electric current is applied through the solenoid 12 winding through its two input leads 29, the magnetic field of the latching solenoid 12 is increased or negated depending upon the direction and magnitude of the current flow. When the solenoid plunger 21 is fully seated in its housing 12 and a current is applied to the solenoid 12 winding that negates the solenoid's magnetic field, the force of the torsion spring mounted on the cam shaft is able to withdraw the plunger from the solenoid housing 12. In the opposite case, where the solenoid plunger 21 is extracted from the solenoid housing 12 and a current is applied to the solenoid 12 winding that increases the solenoid's magnetic field, the magnetic field of the solenoid overcomes the torsion spring's force and the plunger is magnetically pulled back into the solenoid 12 housing.

Figure 2:
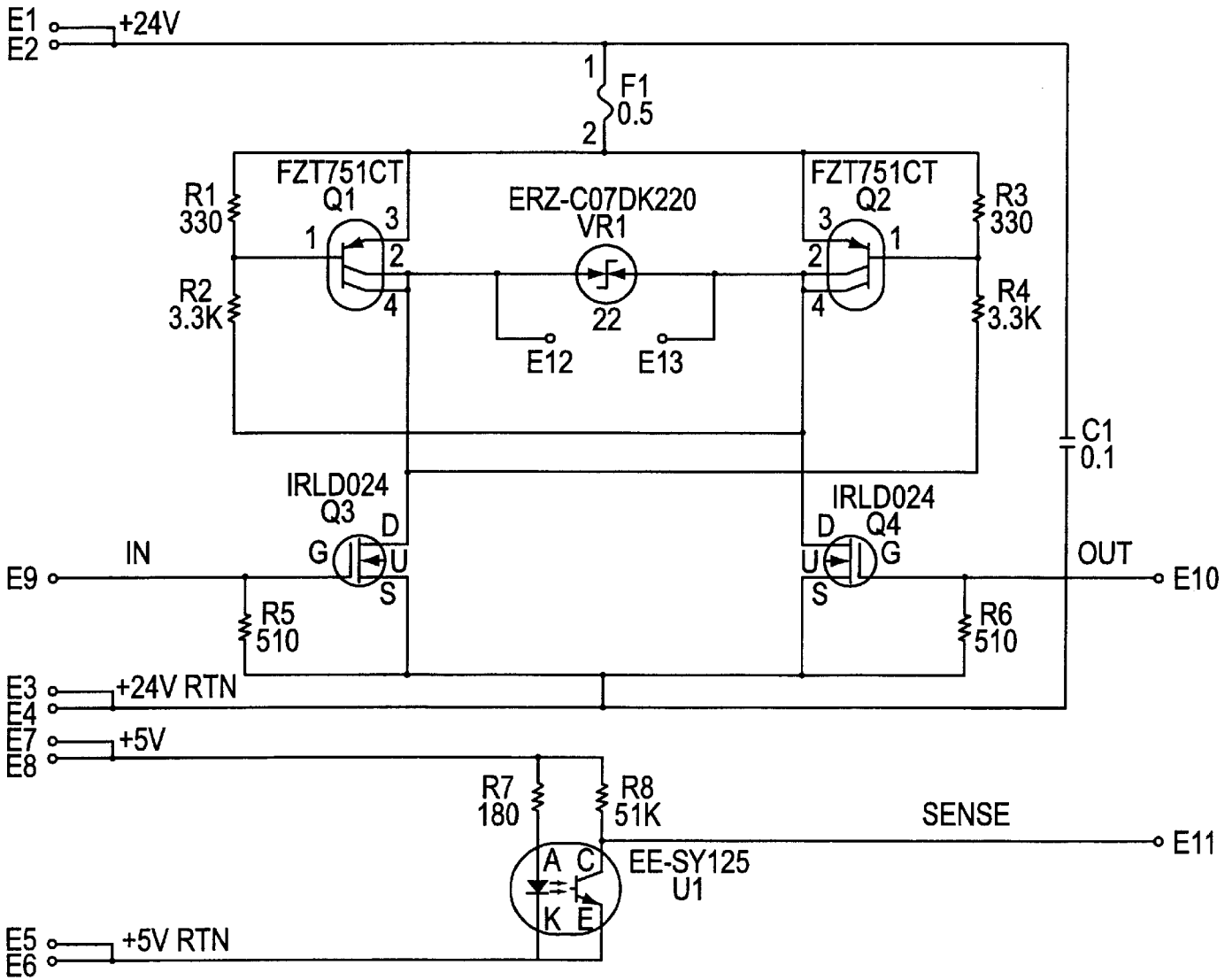
FIG. 2 is a schematic of the toggle switch electronic drive circuit card assembly.

Mounted to the opposite side of each solenoid bracket is one of two identical electronic drive circuit card assemblies 10 that provide directional current flow to each of the solenoid 12 windings. Each of the two magnetic latching solenoids 12 is individually controlled by a electronic drive circuit card assembly 10. The schematic diagram for the electronic drive circuit card assembly 10 is shown in FIG. 2.

Operation of the electronic drive circuit card assembly 10 is as follows. When a TTL level voltage is applied to the gate of the lower left FET transistor (Q3), its drain-to-source impedance goes to a minimum value (typically less than 1 ohm). This condition effectively connects the 24 Volt return at plated through holes E3 and E4 to one lead of the solenoid 12 winding, which is soldered to a plated through hole on the electronic drive circuit card assembly 10 designated E12. The low impedance of FET transistor Q3 also biases the upper right PNP transistor (Q2) through resistors R3 and R4, turning it on, thus allowing current to flow through the emitter-to-collector junctions and into the opposite lead of the solenoid 12 winding, which is soldered at plated through hole E13. R3 and R4 are selected to bias Q2 into saturation whenever Q3 is turned on.

Reverse current flow through the solenoid 12 winding is obtained when the lower right FET transistor (Q4) is turned on. When a TTL level voltage is applied to the gate of the lower right FET transistor (Q4), its drain-to-source impedance goes to a minimum value (typically less than 1 ohm). This condition effectively grounds the lead of the solenoid 12 winding that is soldered at E13 (which was ungrounded with forward current flow). The low impedance also biases the upper left PNP transistor (Q1) through resistors R1 and R2, turning it on, thus allowing current to flow through the emitter-to-collector junctions and into the opposite lead of the solenoid winding 12, which is soldered at E12 (which was grounded with forward current flow), thereby allowing a reverse current flow through the solenoid 12 winding. R1 and R2 are selected to bias Q1 into saturation whenever Q4 is turned on. On Q1 and Q2, pin 1 is the base, pins 2 and 4 are the collectors, and pin 3 is the emitter.

The polysilicon fuse (F1) protects the circuit in the event both FET transistors are turned on at the same time. The value of F1 is rated at 0.5 amps and is selected to allow for one solenoid to pass but in the event that both FET transistors are turned on at the same time the fuse would open. The transient suppressor (VR1) is placed across the solenoid 12 winding to reduce back EMF transients whenever the solenoid 12 winding current is turned off. C1 is a 0.1 microfarad bypass capacitor. It presents a low impedance to high frequency noise on the power line and shunts the noise to ground.

Each solenoid's 12 push rod 19 position is sensed by means of a photo reflective sensor (U1) located on each electronic drive circuit card assembly 10. This sensor U1 is capable of transmitting a beam of light and then detecting if this light beam has been reflected off of a nearby surface. Each push rod 19 has a machined flat surface 26 that reflects the beam of light generated by the sensor U1 that is on the electronic drive circuit card assembly 10. This light beam is detected by the sensor U1 whenever the push rod 19 is extended from the solenoid 12, i.e., the solenoid's plunger 21 is in the "out" position. Conversely, no light is reflected when the push rod 19 is not extended; i.e., the solenoid's plunger 21 is in the "in" position. Monitoring of the sensor's U1 output for each solenoid 12 provides for remote detection of the position of the remotely controlled toggle switch. Resistors R5 and R6 bias the inputs of FET transistors Q3 and Q4 off in the absence of an input signal and provide for noise immunity, while resistors R7 and R8 bias the input and output circuits, respectively, of the optical sensor.

Eleven other plated through holes are contained on the electronic drive circuit card assembly 10. E1 and E2 provide connections for inputting +24 volt DC power. E3 and E4 provide the return path connection for +24 volt power. Similarly, E7 and E8 provide connections for +5 volt DC power and E5 and E6 provide the return path for +5 volt power. Plated through holes E9 and E10 provide solder connections for the TTL input signals that control FET transistors Q3 and Q4, respectively. E9 and E10 are the locations of a first and a second input for the electronic drive circuit card assembly. On FIG. 2, the labels "IN" and "OUT" refer to the plunger position. Plated through hole E11 provides a connection point to the output of photo sensor U1.

Figure 5:
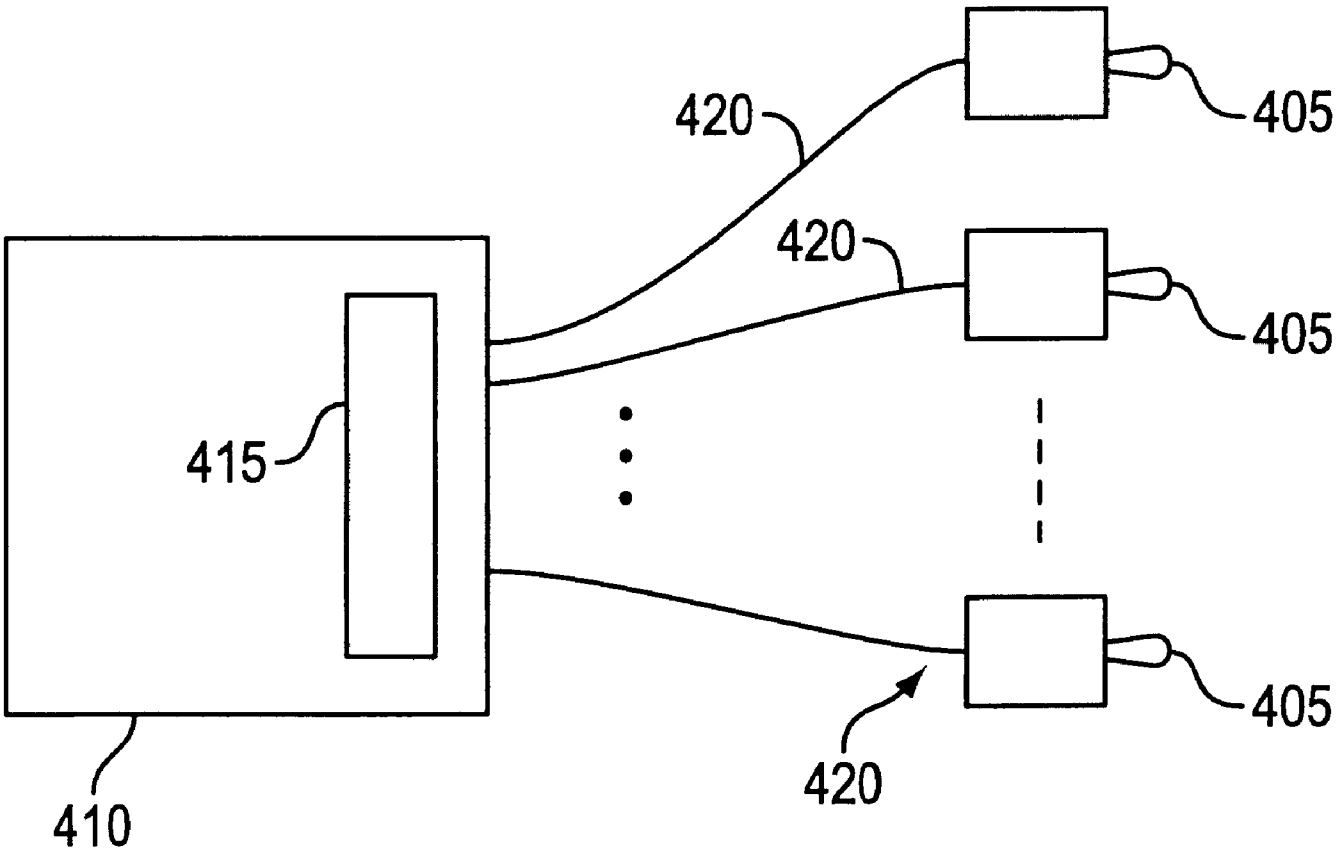
FIG. 5 illustrates a plurality of remotely controlled toggle switches in a maintenance system trainer.

FIG. 5 shows a plurality of remotely controlled toggle switches that comprise a maintenance system trainer. The trainer would control the operation of all of the remotely controlled toggle switches from his/her station. The maintenance system trainer comprises a plurality of remotely controlled toggle switches 405. Each remotely controlled toggle switch 405 is connected and electrically coupled to a control means via signal carrying means 420. The control means is a computer 410 having software 415 resident therein. The software generates control voltage pulses, which control the operation of the remotely controlled toggle switches. This is accomplished when the control voltage pulses, along with 24 volt power and 24 volt and 5 volt power returns are transmitted to the electronic drive circuit card assembly of the simulated toggle switch as signals to inputs E1–E10 of the electronic drive circuit card assembly.

While the invention has been disclosed in this patent application by reference to the details of preferred embodiments of the invention, it is to be understood that the disclosure is intended in an illustrative, rather than in a limiting sense, as it is contemplated that modifications will readily occur to those skilled in the art, within the spirit of the invention and the scope of the appended claims.

What we claim as our invention is:

1. A simulated toggle switch comprising:

a mounting bracket, having a top, a bottom, two sides, a back and a front;

a bat handle, said bat handle attached to the front of said mounting bracket;

a first spring roll pin, said first spring roll pin connected to said bat handle, and which first spring roll pin provides a pivot point for said bat handle;

a second spring roll pin connected to said bat handle;

a first cam and a second cam each having a notch, wherein said notch of each of said cams is engagingly connected to said second spring roll pin in said bat handle;

a round shaft, wherein said round shaft supports and allows for the rotation of said first and second cams and a torsion spring;

a top and a bottom solenoid, each solenoid further being mounted inside a housing, and a plunger seated inside each of said housings, each housing being attached to said mounting bracket;

two push rods each reciprocally connected to one of said plungers by a rear spring roll pin, said plunger from said top solenoid is connected to said first cam by said front spring roll pin and said plunger from said bottom solenoid is connected to said second cam by a front spring roll pin;

whereby, when said plunger from said top solenoid extends forward, said first cam rotates counterclockwise on said round shaft enabling said notch of said first cam to press down on said second spring roll pin of said bat handle, thereby pushing said bat handle to its uppermost position, and when said plunger from said bottom solenoid extends forward, said second cam rotates clockwise on said round shaft enabling said notch of said second cam to press up on said second spring roll pin of said bat handle, thereby pushing said bat handle to its lowermost position, and when both solenoid plungers are retracted, said bat handle is centered.

2. The remotely controlled toggle switch according to claim 1, further comprising a torsion spring reciprocally captive between said front spring roll pin of said first and second cam to preload said bat handle.

3. The remotely controlled toggle switch according to claim 1, wherein each of said electronic drive circuit card assemblies further comprises a transient suppressor VR1 connected and electrically coupled in parallel with said solenoid winding leads to reduce back EMF transients.

4. The remotely controlled toggle switch according to claim 1, further comprising:

each solenoid further having a first and a second coil winding lead, an electronic drive circuit card assembly for each of said solenoids having a first input and a second input, a first output connected and electrically coupled to said first lead of said corresponding solenoid winding, and a second output connected and electrically coupled to said second lead of said corresponding solenoid winding;

whereby, when a control voltage is applied to said first input of said electronic drive circuit card assembly, said plunger is extracted from said solenoid housing by said torsion spring, and when a control voltage is applied to said second input of said electronic drive circuit card assembly, said plunger is pulled into said solenoid housing.

5. The remotely controlled toggle switch according to claim 4, wherein each of said electronic drive circuit card assemblies further comprises:

a first amplifier Q1 connected and electrically coupled between a supply voltage and said first lead of said solenoid winding, and a second amplifier Q2 connected and electrically coupled between the supply voltage and said second lead of said solenoid winding;

a third amplifier Q3 connected and electrically coupled between said first input of said electronic drive circuit card assembly and said first lead of said solenoid winding, and a fourth amplifier Q4 connected and electrically coupled between said second input of said electronic drive circuit card assembly and said second lead of said solenoid winding;

whereby, when a control voltage is applied to said first input of said electronic drive circuit card assembly, current flows from said second amplifier Q2 through said second lead of said solenoid winding to said first lead of said solenoid winding through said third amplifier Q3, and when a control voltage is applied to said second input of said electronic drive circuit card assembly, current flows from said first amplifier Q1 through said first lead of said solenoid winding to said second lead of said solenoid winding through said fourth amplifier Q4.

6. The remotely controlled toggle switch according to claim 5, wherein said first and second amplifiers are PNP transistors and said third and fourth amplifiers are FET transistors.

7. The remotely controlled toggle switch according to claim 6, in which:

said first amplifier Q1 has an emitter connected and electrically coupled to the supply voltage, a collector connected and electrically coupled to said first lead of said solenoid winding, and a base connected and electrically coupled through a series resistance R2 to said second lead of said solenoid winding;

said second amplifier Q2 has an emitter connected and electrically coupled to the supply voltage, a collector connected and electrically coupled to said second lead of said solenoid winding, and a base connected and electrically coupled through a series resistance R4 to said first lead of said solenoid winding;

said third amplifier Q3 has a gate connected and electrically coupled to said first input of said electronic drive circuit card assembly, a drain connected and electrically coupled to said first lead of said solenoid winding, and a source connected and electrically coupled to a 24 Volt return; and said fourth amplifier Q4 has a gate connected and electrically coupled to said second input of said electronic drive circuit card assembly, a drain connected and electrically coupled to said second lead of said solenoid winding, and a source connected and electrically coupled to the 24 Volt return.

8. The remotely controlled toggle switch according to claim 4, wherein said electronic drive circuit card assembly further comprises an optical device U1 for generating a light and detecting said light upon its reflection off of a surface in close proximity to said optical device.

9. The remotely controlled toggle switch according to claim 8, wherein said optical device U1 is a photo generator/detector.

10. The remotely controlled toggle switch according to claim 1, further comprising:

each solenoid further having a first and a second coil winding lead, an electronic drive circuit card assembly for each of said solenoids having a first input and a second input, a first output connected and electrically coupled to said first lead of said corresponding solenoid winding, and a second output connected and electrically coupled to said second lead of said corresponding solenoid winding;

whereby, when a control voltage is applied to said first input of said electronic drive circuit card assembly, said plunger is extracted from said solenoid housing by said torsion spring, and when a control voltage is applied to said second input of said electronic drive circuit card assembly, said plunger is pulled into said solenoid housing, or in the alternative, in the absence of a control voltage being applied, said remotely controlled toggle switch may be operated manually.

11. The remotely controlled toggle switch according to claim 10, wherein each of said electronic drive circuit card assemblies further comprises:

a first amplifier Q1 connected and electrically coupled between a supply voltage and said first lead of said solenoid winding, and a second amplifier Q2 connected and electrically coupled between the supply voltage and said second lead of said solenoid winding;

a third amplifier Q3 connected and electrically coupled between said first input of said electronic drive circuit card assembly and said first lead of said solenoid winding, and a fourth amplifier Q4 connected and electrically coupled between said second input of said electronic drive circuit card assembly and said second lead of said solenoid winding;

whereby, when a control voltage is applied to said first input of said electronic drive circuit card assembly, current flows from said second amplifier Q2 through said second lead of said solenoid winding to said first lead of said solenoid winding through said third amplifier Q3, and when a control voltage is applied to said second input of said electronic drive circuit card assembly, current flows from said first amplifier Q1 through said first lead of said solenoid winding to said second lead of said solenoid winding through said fourth amplifier Q4, or in the alternative, in the absence of a control voltage being applied, said remotely controlled toggle switch may be operated manually.

12. The remotely controlled toggle switch according to claim 11, wherein said first and second amplifiers are PNP transistors and said third and fourth amplifiers are FET transistors.

13. The remotely controlled toggle switch according to claim 12, in which:

said first amplifier Q1 has an emitter connected and electrically coupled to the supply voltage, a collector connected and electrically coupled to said first lead of said solenoid winding, and a base connected and electrically coupled through a series resistance R2 to said second lead of said solenoid winding;

said second amplifier Q2 has an emitter connected and electrically coupled to the supply voltage, a collector connected and electrically coupled to said second lead of said solenoid winding, and a base connected and electrically coupled through a series resistance R4 to said first lead of said solenoid winding;

said third amplifier Q3 has a gate connected and electrically coupled to said first input of said electronic drive circuit card assembly, a drain connected and electrically coupled to said first lead of said solenoid winding, and a source connected and electrically coupled to a 24 Volt return; and said fourth amplifier Q4 has a gate connected and electrically coupled to said second input of said electronic drive circuit card assembly, a drain connected and electrically coupled to said second lead of said solenoid winding, and a source connected and electrically coupled to the 24 Volt return.

14. The remotely controlled toggle switch according to claim 10, wherein said electronic drive circuit card assembly further comprises an optical device U1 for generating a light and detecting said light upon its reflection off of a surface in close proximity to said optical device.

15. The remotely controlled toggle switch according to claim 14, wherein said optical device U1 is a photo generator/detector.

16. A maintenance trainer system comprising a plurality of remotely controlled toggle switches, wherein each of said remotely controlled toggle switches comprises:

a mounting bracket, having a top, a bottom, two sides, a back and a front;

a bat handle, said bat handle attached to the front of said mounting bracket;

a first spring roll pin, said first spring roll pin connected to said bat handle, and which first spring roll pin provides a pivot point for said bat handle;

a second spring roll pin connected to said bat handle;

a first cam and a second cam each having a notch, wherein said notch of each of said cams is engagingly connected to said second spring roll pin in said bat handle;

a round shaft, wherein said round shaft supports and allows for the rotation of said first and second cams and a torsion spring;

a top and a bottom solenoid, each solenoid further being mounted inside a housing, and a plunger seated inside each of said housings, each housing being attached to said mounting bracket;

two push rods each reciprocally connected to one of said plungers by a rear spring roll pin, said plunger from said top solenoid is connected to said first cam by said front spring roll pin and said plunger from said bottom solenoid is connected to said second cam by a front spring roll pin;

whereby, when said plunger from said top solenoid extends forward, said first cam rotates counterclockwise on said round shaft enabling said notch of said first cam to press down on said spring roll pin of said bat handle, thereby pushing said bat handle to its uppermost position, and when said plunger from said bottom solenoid extends forward, said second cam rotates clockwise on said round shaft enabling said notch of said second cam to press up on said spring roll pin of said bat handle, thereby pushing said bat handle to its lowermost position, and when both solenoid plungers are retracted, said bat handle is centered.

17. The maintenance trainer system according to claim 16, wherein said remotely controlled toggle switch further comprises a torsion spring reciprocally captive between said first and second cams to preload said bat handle.

18. The maintenance trainer system according to claim 16, wherein each of said electronic drive circuit card assemblies further comprises a transient suppressor VR1 connected and electrically coupled in parallel with said solenoid winding leads to reduce back EMF transients.

19. The maintenance trainer system according to claim 16, wherein each of said remotely controlled toggle switch further comprises:

a pulse generation means; and an electronic drive circuit card assembly for each of said solenoids, each of said controller circuit card assemblies having a first input and a second input, a first output connected and electrically coupled to said first lead of said corresponding solenoid winding, and a second output connected and electrically coupled to said second lead of said corresponding solenoid winding;

wherein said electronic drive circuit card assembly is remotely controlled by said pulse generation means, and whereby, when a control voltage is applied to said first input of said electronic drive circuit card assembly, said plunger is extracted from said solenoid housing by said torsion spring, and when a voltage is applied to said second input of said electronic drive circuit card assembly, said plunger is pulled into said solenoid housing.

20. The maintenance trainer system according to claim 19, wherein each of said electronic drive circuit card assemblies further comprises:

a first amplifier Q1 connected and electrically coupled between the supply voltage and said first lead of said solenoid winding, and a second amplifier Q2 connected and electrically coupled between the supply voltage and said second lead of said solenoid winding;

a third amplifier Q3 connected and electrically coupled between said first input of said electronic drive circuit card assembly and said first lead of said solenoid winding, and a fourth amplifier Q4 connected and electrically coupled between said second input of said electronic drive circuit card assembly and said second lead of said solenoid winding;

whereby when a control voltage is applied to said first input of said electronic drive circuit card assembly, current flows from said second amplifier Q2 through said second lead of said solenoid winding to said first lead of said solenoid winding through said third amplifier Q3, and when a control voltage is applied to said second input of said electronic drive circuit card assembly, current flows from said first amplifier Q1 through said first lead of said solenoid winding to said second lead of said solenoid winding through said fourth amplifier Q4.

21. The maintenance trainer system according to claim 20, wherein said first and second amplifiers are PNP transistors and said third and fourth amplifiers are FET transistors.

22. The maintenance trainer system according to claim 21, wherein:

said first amplifier Q1 has an emitter connected and electrically coupled to a supply voltage, a collector connected and electrically coupled to said first lead of said solenoid winding, and a base connected and electrically coupled through a series resistance R2 to said second lead of said solenoid winding;

said second amplifier Q2 has an emitter connected and electrically coupled to the supply voltage, a collector connected and electrically coupled to said second lead of said solenoid winding, and a base connected and electrically coupled through a series resistance R4 to said first lead of said solenoid winding;

said third amplifier Q3 has a gate connected and electrically coupled to said first input of said electronic drive circuit card assembly, a drain connected and electrically coupled to said first lead of said solenoid winding, and a source connected and electrically coupled to a 24 Volt return;

said fourth amplifier Q4 has a gate connected and electrically coupled to said second input of said electronic drive circuit card assembly, a drain connected and electrically coupled to said second lead of said solenoid winding, and a source connected and electrically coupled to the 24 Volt return.

23. The maintenance trainer system according to claim 19, wherein said electronic drive circuit card assembly further comprises an optical device U1 for generating a light and detecting said light upon its reflection off of a surface in close proximity to said optical device.

24. The maintenance trainer system according to claim 23, wherein said optical device U1 is a photo generator/detector.

25. The maintenance trainer system according to claim 16, wherein each of said remotely controlled toggle switch further comprises:

a pulse generation means; and an electronic drive circuit card assembly for each of said solenoids, each of said controller circuit card assemblies having a first input and a second input, a first output connected and electrically coupled to said first lead of said corresponding solenoid winding, and a second output connected and electrically coupled to said second lead of said corresponding solenoid winding;

wherein said electronic drive circuit card assembly is remotely controlled by said pulse generation means, and whereby, when a control voltage is applied to said first input of said electronic drive circuit card assembly, said plunger is extracted from said solenoid housing by said torsion spring, and when a voltage is applied to said second input of said electronic drive circuit card assembly, said plunger is pulled into said solenoid housing, or in the alternative, in the absence of a control voltage being applied, said remotely controlled toggle switch may be operated manually.

26. The maintenance trainer system according to claim 25, wherein each of said electronic drive circuit card assemblies further comprises:

a first amplifier Q1 connected and electrically coupled between a supply voltage and said first lead of said solenoid winding, and a second amplifier Q2 connected and electrically coupled between the supply voltage and said second lead of said solenoid winding;

a third amplifier Q3 connected and electrically coupled between said first input of said electronic drive circuit card assembly and said first lead of said solenoid winding, and a fourth amplifier Q4 connected and electrically coupled between said second input of said electronic drive circuit card assembly and said second lead of said solenoid winding;

whereby when a control voltage is applied to said first input of said electronic drive circuit card assembly, current flows from said second amplifier Q2 through said second lead of said solenoid winding to said first lead of said solenoid winding through said third amplifier Q3, and when a control voltage is applied to said second input of said electronic drive circuit card assembly, current flows from said first amplifier Q1 through said first lead of said solenoid winding to said second lead of said solenoid winding through said fourth amplifier Q4, or in the alternative, in the absence of a control voltage being applied, said remotely controlled toggle switch may be operated manually.

27. The maintenance trainer system according to claim 26, wherein said first and second amplifiers are PNP transistors and said third and fourth amplifiers are FET transistors.

28. The maintenance trainer system according to claim 27, wherein:

said first amplifier Q1 has an emitter connected and electrically coupled to the supply voltage, a collector connected and electrically coupled to said first lead of said solenoid winding, and a base connected and electrically coupled through a series resistance R2 to said second lead of said solenoid winding;

said second amplifier Q2 has an emitter connected and electrically coupled to the supply voltage, a collector connected and electrically coupled to said second lead of said solenoid winding, and a base connected and electrically coupled through a series resistance R4 to said first lead of said solenoid winding;

said third amplifier Q3 has a gate connected and electrically coupled to said first input of said electronic drive circuit card assembly, a drain connected and electrically coupled to said first lead of said solenoid winding, and a source connected and electrically coupled to a 24 Volt return;

said fourth amplifier Q4 has a gate connected and electrically coupled to said second input of said electronic drive circuit card assembly, a drain connected and electrically coupled to said second lead of said solenoid winding, and a source connected and electrically coupled to the 24 Volt return.

29. The maintenance trainer system according to claim 25, wherein said electronic drive circuit card assembly further comprises an optical device U1 for generating a light and detecting said light upon its reflection off of a surface in close proximity to said optical device.

30. The maintenance trainer system according to claim 29, wherein said optical device U1 is a photo generator/detector.

31. A method of controlling a remotely controlled toggle switch comprising the steps of:

applying a current through a first solenoid winding or a second solenoid winding in either a forward or a reverse direction;

extracting a first or second plunger from or pushing said first or second plunger into a first or second solenoid housing, respectively;

moving a first or second cam in a clockwise or counter-clockwise direction; and moving a bat handle to an uppermost, a centered, or a lowermost position.

32. The method according to claim 31, further comprising the steps of:

reciprocally connecting a push rod to each of said first and second plungers, each said push rod having a machined flat surface; and sensing a beam of light reflected from said machined flat surface to determine the position of said remotely controlled toggle switch.

33. A method of controlling a remotely controlled toggle switch located in a maintenance trainer system comprising the steps of:

applying a current through a first solenoid winding or a second solenoid winding in either a forward or a reverse direction;

extracting a first or second plunger from or pushing a first or second plunger into a first or second solenoid housing, respectively;

moving a first or second cam in a clockwise or counter-clockwise direction, and moving a bat handle to an uppermost, a centered, or a lowermost position.

34. The method according to claim 33, further comprising the step of:

sensing a beam of light to determine the position of said remotely controlled toggle switch.

* * * * *